US005851951A

United States Patent [19]

Yamori et al.

[11] Patent Number: 5,851,951

[45] Date of Patent: Dec. 22, 1998

[54] HEAT SENSITIVE RECORDING MATERIAL

[75] Inventors: Tsunefumi Yamori; Shigeji Matsuzawa; Yutaka Isu, all of Amagasaki, Japan

[73] Assignee: Oji Paper Co., Ltd., Tokyo, Japan

[21] Appl. No.: 806,857

[22] Filed: Feb. 26, 1997

[30] Foreign Application Priority Data

Feb. 29, 1996 [JP] Japan ..... 8-071241
Aug. 30, 1996 [JP] Japan ..... 8-249313

[51] Int. Cl.[6] ..... B41M 5/30

[52] U.S. Cl. ..... 503/216; 503/208; 503/213; 503/226

[58] Field of Search ..... 427/150–152; 503/200, 208, 215, 216, 225, 226, 209

[56] References Cited

FOREIGN PATENT DOCUMENTS

A-59-106992 11/1984 Japan ..... 503/200
B-1-52192 9/1989 Japan ..... 503/200

*Primary Examiner*—Bruce H. Hess
*Attorney, Agent, or Firm*—Nikaido, Marmelstein, Murray & Oram LLP

[57] ABSTRACT

A heat sensitive recording material wherein a transparent substrate is formed with a heat sensitive recording layer thereon, the heat sensitive recording material being characterized in that the heat sensitive recording layer comprises at least a layer containing a color acceptor and a layer containing a dye, the color acceptor-containing layer being formed by a binder-containing solvent coating method and/or vapor deposition effected with a plasma created, the dye-containing layer being formed by vapor deposition or vapor deposition effected with a plasma created.

9 Claims, No Drawings

HEAT SENSITIVE RECORDING MATERIAL

The present invention relates to heat sensitive recording materials utilizing a color forming reaction between a colorless or light-colored basic dye and a color acceptor, and more particularly to heat sensitive recording materials excellent in transparency, remaining unimpaired in transparency with time and having a high recording sensitivity.

Heat sensitive recording materials are well known which utilize a color forming reaction between a colorless or light-colored basic dye and an organic or inorganic color acceptor to obtain recorded images by thermally bringing the two chromogenic substances into contact with each other. Such heat sensitive recording materials are relatively inexpensive, while recording devices therefor are compact and relatively easy to maintain, so that these materials serve as recording media for facsimile systems, computers, etc. and are also used in a wide variety of fields.

For wider use, recording materials include many which are prepared from film or synthetic paper substrates besides paper substrates. Available as one of such materials is a heat sensitive recording film of high transparency comprising a transparent film as its substrate and adapted for use in medicine, OHPs or drawing.

To enhance the transparency of the recording film, it is attempted to use a particulate material of smaller particle size for the recording layer or protective layer, or to increase the proportion of binder, but the transparency still remains to be improved. Further a thin-film photorecording medium is proposed wherein a light absorber layer, chromogenic agent layer and color acceptor layer are formed as superposed by vacuum evaporation as disclosed in JP-B-52191/1989, whereas the medium is insufficient in transparency and presently requires a special recording device. Although JP-A-106992/1984 similarly teaches a technique of superposing a chromogenic agent layer and color acceptor layer by vacuum evaporation, the technique is likewise unsatisfactory in transparency and has yet to be improved in the preservation stability of recorded images.

An object of the present invention is to provide a heat sensitive recording material which is excellent in transparency, remaining unimpaired in transparency with time and which has a high recording sensitivity.

The present invention provides a heat sensitive recording material wherein a transparent substrate is formed with a heat sensitive recording layer thereon, the heat sensitive recording material being characterized in that the heat sensitive recording layer comprises at least a layer containing a color acceptor and a layer containing a basic dye, the color acceptor-containing layer being formed by a binder-containing solvent coating method and/or vapor deposition effected with a plasma generated, the dye-containing layer being formed by vapor deposition or vapor deposition effected with a plasma generated.

According to the present invention, the process for forming the heat sensitive layer is not limited particularly except that the color acceptor-containing layer is formed by a binder-containing solvent coating method and/or vapor deposition effected with a plasma generated, and that the dye-containing layer is formed by vapor deposition or vapor deposition effected with a plasma generated. For example, the solvent coating method involves use of a heat-fusible substance, preservability improving agent, ultraviolet absorber or the like when required in addition to the binder, or vapor deposition process and/or plasma-vapor deposition process may be used.

For use in forming the color acceptor-containing layer by the binder-containing solvent coating method according to the invention, examples of organic solvents for dissolving the color acceptor and binder are hydrocarbons, hydrocarbon halides, alcohols, ethers, acetals, ketones and esters. These solvents are used singly or in mixture.

Examples of hydrocarbons are benzene, toluene, xylene, cyclohexane, methylcyclohexane, cyclopentane, petroleum ether and hexane. Examples of hydrocarbon halides are chloroform, methyl chloride, carbon tetrachloride, chlorobenzene and dichlorobenzene. Examples of alcohols are methanol, ethanol, propanol, isopropanol and butanol. Examples of ethers are ethyl ether and isopropyl ether. Examples of acetals are diethyl acetal. Examples of ketones are acetone, methyl ethyl ketone and diethyl ketone. Examples of esters are ethyl acetate, methyl acetate and methyl propionate. The solvent is not limited to the above.

The binder to be used in the invention is not limited specifically insofar as it is a resin soluble in organic solvents. Such resins are preferably thermoplastic resins, more preferably thermoplastic resins which are soluble in the organic solvents exemplified above.

Examples of useful thermoplastic resins are acrylic resins, polystyrenes, poly ($\alpha$-methylstyrene), vinyl chloride-vinyl acetate copolymer, ethylene-vinyl acetate copolymer, polyvinyl acetals, polyester resins, polyurethane resins, cumarone resins, nylon resins and cellulose polymer such as nitrocellulose. The resin is not limited to the above and can be used singly or in at least two of them. Among the above acrylic resin, examples of acrylic monomers are (meth) acrylic acid, (meth)acrylic esters such as methyl (meth) acrylate, ethyl (meth)acrylate and butyl (meth)acrylate, (meth)acrylamide and (meth)acrylonitrile. These acrylic monomers are polymerized singly or in at least two of them. Further, other ethylenically unsaturated monomer such as itaconic acid, vinyl chloride, vinylidene chloride, vinyl acetate, styrene, ethylene, propylene and butadiene can be copolymerized with the acrylic monomer. As required, the acrylic resin can be modified such as hydrolysis and acetalization.

For use in forming the first layer of the heat sensitive recording layer, the binder is used in an amount which is not limited particularly. However, the amount is preferably adjusted in the range of 0.5 to 90 wt. %, more preferably 1 to 60 wt. % , based on the total amount of solids in the coating composition.

The vapor deposition process to be used in the present invention can be, for example, resistance heating or electron beam heating. When the material of the color acceptor-containing layer or the dye-containing layer, and other material for forming the heat sensitive layer are deposited with a plasma generated, it becomes possible to control the crystallinity of the deposited layer and to give improved strength to the layer.

There are various plasma generating methods including DC plasma method, high-frequency plasma method and microwave plasma method. Especially, the high-frequency plasma method assures easy handling and is therefore preferable. The gas to be used is, for example, an inert gas such as He or Ar, $N_2$, $O_2$, $H_2$, $CO_2$, gas mixture or air. Although the rate of flow of the gas and the magnitude of energy to be applied are not limited specifically insofar a plasma can be produced under the conditions involved, it is desired that the high-frequency plasma method give an output of up to about 100 W in view of the degree of discoloration of the deposited film and the recording density.

Examples of color acceptors useful in the invention are phenolic compounds such as 4,4'-isopropylidenediphenol, 1,1-bis(4-hydroxyphenyl)cyclohexane, 2,2-bis(4-hydroxyphenyl)-4-methylpentane, 4,4'-dihydoroxydiphenylsulfide, hydroquinone monobenzyl ether, benzyl 4-hydroxybenzoate, 4,4'-dihydroxydiphenylsulfone, 2,4'-dihydroxydiphenylsulfone, 4-hydroxy-4'-isopropoxydiphenylsulfone, bis(3-aryl-4-hydroxyphenyl)sulfone, 4-hydroxy-4'-methyldiphenylsulfone, 4-hydroxyphenyl-4'-benzyloxyphenylsulfone, 3,4-dihydroxyphenyl-4'-methylphenylsulfone, bis(4-hydroxyphenyl-thioethoxy) methane, 1,5-di(4-hydroxyphenylthio)-3-oxapentane, butyl bis(p-hydroxyphenyl)acetate, methyl bis(p-hydroxyphenyl) acetate, 1,1-bis(4-hydroxyphenyl)-1-phenylethane, 1,4-bis [α-methyl-α-(4'-hydroxyphenyl)-ethyl]benzene, 1,3-bis[α-methyl-α-(4'-hydroxyphenyl)-ethyl]benzene, di(4-hydroxy-3-methylphenyl)sulfide, 2,2'-thiobis(3-tert-octylphenol), 2,2'-thiobis(4-tert-octylphenol) and 2,4-dihydroxy-2'-methoxybenzanilide; thiourea compounds such as N,N'-di-m-chlorophenylthiourea; aromatic carboxylic acid such as p-chlorobenzoic acid, 4-[2-(p-methoxyphenoxy)ethyloxy] salicylic acid, 4-[3-(p-tolylsulfonyl)propyloxy]salicylic acid and 5-[p-(2-p-methoxyphenoxyethoxy)cumyl]salicylic acid, salts of the aromatic carboxylic acid and a polyvalent metals such as zinc, magnesium, aluminum, calcium, titanium, manganese, tin and nickel; complex of antipyrine and zinc thiocyanate; complex salt of zinc, terephthalaldehyde acid and other aromatic carboxylic acid; organic phosphoric acid compound such as octadecylphosphoric acid; compounds of the formula (1) below and having arylsulfonylaminocarbonylamino group $$R_1-SO_2NHC(=O)NH- \quad (1)$$

wherein $R_1$ is unsubstituted aromatic group or aromatic group substituted with at least one selected among lower alkyl, lower alkoxy and halogen atom.

(1) Examples of the compound of the formula (1) having one arylsulfonylaminocarbonylamino group are N-(p-toluenesulfonyl)-N'-phenylurea, N-(p-toluenesulfonyl)-N'-(p-methoxyphenyl)urea, N-(p-toluenesulfonyl)-N'-(o-tolyl) urea, N-(p-toluenesulfonyl)-N'-(m-tolyl)urea, N-(p-toluenesulfonyl)-N'-(p-tolyl)urea, N-(p-toluenesulfonyl)-N'-(p-ethylphenyl)-urea, N-(p-toluenesulfonyl)-N'-(p-n-propylphenyl)urea, N-(p-toluenesulfonyl)-N'-(p-n-butylphenyl)urea, N-(p-toluenesulfonyl)-N',N'-diphenylurea, N-(p-toluenesulfonyl)-N'-(p-hydroxyphenyl) urea, N-(p-toluenesulfonyl)-N'-(o-chlorophenyl)urea, N-(p-toluenesulfonyl)-N'-(m-chlorophenyl)urea, N-(p-toluenesulfonyl)-N'-(2,4-dichlorophenyl)urea, N-(p-toluenesulfonyl)-N'-methyl-N'-phenylurea, N-(p-toluenesulfonyl)-N'-benzylurea, N-(p-toluenesulfonyl)-N'-(1-naphthyl)urea, N-(p-toluenesulfonyl)-N'-[1-(2-methylnaphthyl)]urea, N-(benzenesulfonyl)-N'-phenylurea, N-(p-chlorobenzenesulfonyl)-N'-phenylurea, N-(o-toluenesulfonyl)-N'-phenylurea, N-(p-toluenesulfonyl)-N'-methylurea, N-(p-toluenesulfonyl)-N'-ethylurea, N-(p-toluenesulfonyl)-N'-(2-phenoxyethyl)urea, N,N'-bis(p-toluenesulfonyl)urea, N-(p-toluenesulfonyl)-N'-(o-diphenyl)urea, N-(p-toluenesulfonyl)-N'-(p-ethoxycarbonylphenyl)urea, N-(p-toluenesulfonyl)-N'-butylurea, N-(p-chlorobenzenesulfonyl)-N'-propylurea and N-(p-methoxybenzenesulfonyl)-N'-phenylurea.

(2) Examples of the compound of the formula (1) having at least two arylsulfonylaminocarbonylamino group are bis (p-toluenesulfonylaminocarbonylamino)ketone, 1,2-bis(p-toluenesulfonylaminocarbonylamino)ethane, 1,1,6,6-tetra (p-toluenesulfonylaminocarbonylamino)heptane, 1,5-bis(p-toluenesulfonylaminocarbonylamino)-3-oxapentane, 1,5-bis (p-toluenesulfonylaminocarbonylamino)-3-thiopentane, 1,3-bis (p-toluenesulfonylaminocarbonylamino)-2-propanone, 1,5-bis(p-toluenesulfonylaminocarbonylamino)-3-[2'-(p-toluenesulfonylaminocarbonylamino)ethyl]-3-azapentane, 1,3-bis(p-toluenesulfonylaminocarhonylaminomethyl)henzene, 1,4-bis(p-toluenesulfonylaminocarbonylaminomethyl)benzene, 4,4'-bis(p-toluenesulfonylaminocarbonylamino)-diphenylmethane, 4,4'-bis (o-toluenesulfonylaminocarbonylamino)-diphenylmethane, 4,4 -bis(benzenesulfonylaminocarbonylamino)-diphenylmethane, 4,4'-bis (naphthalenesulfonylamihocarbonylamino)-diphenylmethane, 2,2-bis[4',4"-(p-toluenesulfonylaminocarbonylamino)phenyl]-propane, 1,2-bis[4'-(p-toluenesulfonylaminocarbonylamino)phenyloxy]-ethane, 2,5-bis(p-toluenesulfonylaminocarbonylaminomethyl)furan, 1,3-bis (p-toluenesulfonylaminocarbonylamino)benzene, 1,4-bis(p-toluenesulfonylaminocarbonylamino)benzene, 1,5-bis(p-toluenesulfonylaminocarbonylamino)naphthalene, 1,8-bis (p-toluenesulfonylaminocarbonylamino)naphthalene, 4,4'-bis(p-toluenesulfonylaminocarbonylamino)diphenyl ether, 3,3'-bis(p-toluenesulfonylaminocarbonylamino) diphenylsulfone, 2,4-bis(p-toluenesulfonylaminocarbonylamino)toluene, 2,6-bis(p-toluenesulfonylaminocarbonylamino)toluene, 4,4'-bis(p-toluenesulfonylaminocarbonylamino)diphenylsulfide and 3,4'-bis(p-toluenesulfonylaminocarbonylamino)diphenyl ether. The color acceptor can be used singly or in at least two of them.

Especially useful color acceptors are compounds such as 2,4-dihydroxy-2'-methoxybenzanilide, N-(p-toluenesulfonyl)-N'-phenylurea, N-(p-toluenesulfonyl)-N'-(p-methoxyphenyl)urea, N-(p-toluenesulfonyl)-N'-(o-tolyl) urea, N-(p-toluenesulfonyl)-N'-(m-tolyl)urea, N-(p-toluenesulfonyl)-N'-(p-tolyl)urea, N-(p-toluenesulfonyl)-N'-(p-ethylphenyl)urea, N-(p-toluenesulfonyl)-N'-(p-n-propylphenyl)urea, N-(p-toluenesulfonyl)-N'-(p-hydroxyphenyl)urea and 4,4'-bis(p-toluenesulfonylaminocarbonylamino)-diphenylmethane. When these compounds are checked for melting point and melting point range according to JIS K 0064 by melting the compound in a capillary tube until any solid no longer remains, further maintaining the melting end-point temperature for 5 minutes to hold the compound in its final molten state, and allowing the compound-containing tube to stand in an atmosphere of 0° C. for 5 hours, as placed into this atmosphere within 10 seconds thereafter, the compound subsequently remains free of the crystallization set forth in JIS K 0211. These compounds afford a coating layer having excellent transparency and high preservability even at a high concentration, and are therefore preferable to use.

Various known colorless or light-colored basic dyes are usable in the invention. Examples thereof are blue-forming dyes such as 3,3-bis(p-dimethylaminophenyl)-6-dimethylaminophthalide, 3-(4-diethylamino-2-methylphenyl)-3-(4-dimethylaminophenyl)-6-dimethylaminophthalide. 3-diethylamino-7-dibenzylamino-benzo[a]fluoran; green-forming dyes such as 3-(N-ethyl-N-p-tolyl)amino-7-N-methylanilinofluoran, 3-diethylamino-7-anilinofluoran, 3-diethylamino-7-dibenzylaminofluoran; red-forming dyes such as 3,6-bis(diethylamino)fluoran-γ-anilinolactam, 3-cyclohexylamino-6-chlorofluoran, 3-dibutylamino-6-methyl-7-bromofluoran, 3-diethylamino-7-methylfluoran, 3-diethylamino-6-methyl-7-chlorofluoran, 3-diethylamino-7-chlorofluoran, rohdamine(o-chloroanilino)lactam, rohdamine(p-chloroanilino)lactam, 3-diethylamino-7,8-benzofluoran, 3-(N-ethyl-p-toluidino)-7-methylfluoran, 3-diethylamino-6,8-dimethylfluoran, 3-(N-ethyl-N-isoamyl)amino-benzo[a]fluoran, 3,3'-bis(1-n-butyl-2-methylindole-3-yl)phthalide, 2-(4-dodecyloxy-3-methoxystyryl)quinoline; black-forming dyes such as 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl) amino-6-methyl-7-anilinofluoran, 3-di(n-pentyl)amino-6-methyl-7-anilinofluoran, 3-diethylamino-7-(o-chlorophenylamino)fluoran, 3-di(n-butyl)amino-7-(o-chlorophenylamino)fluoran, 3-diethylamino-7-(o-fluorophenylamino)fluoran, 3-di(n-butyl)amino-7-(o-fluorophenylamino)fluoran, 3-(N-ethyl-p-toluidino)-6-methyl-7-anilinofluoran, 3-(N-ethyl-p-toluidino)-6-methyl-7-(p-toluidino)fluoran, 3-(N-ethyl-N-tetrahydrofluflylamino)-6-methyl-7-anilinofluoran, 3-diethylamino-6-chloro-7-anilinofluoran, 3-(N-methyl-N-n-propylamino)-6-methyl-7-anilinofluoran, 3-dimethylamino-6-methyl-7-anilinofluoran, 3-dibutylamino-6-methyl-7-m-toluidinofluoran, 3-(N-n-hexyl-N-ethyl)amino-6-methyl-7-anilinofluoran, 3-(N-ethyl-N-isobutyl)amino-6-methyl-7-anilinofluoran, 3-diethylamino-6-methyl-7-p-ethoxyanilinofluoran, 3-pyrrolidino-6-methyl-7-anilinofluoran, 3-piperidino-6-methyl-7-anilinofluoran, 2,2-bis{4-(6'-(N-cyclohexyl-N-methylamino)-3'-methylspiro(phthalido-3,9'-xanthene)-2'-yl-amino)phenyl}propane, 3-diethylamino-7-(3'-trifluoromethylphenyl)aminofluoran; dyes having absorbing wave-length in near infrared region such as 3 3-bis[1-(4-methoxyphenyl)-1-(4-dimethylaminophenyl)-ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, 3,3-bis[1,1'-bis(4-pyrrolidinophenyl)-ethylene-2-yl]-4,5,6,7-tetrabromophthalide, 3-p-(p-dimethylaminoanilino)anilino-6-methyl-7-chlorofluoran, 3-p-(p-chloroanilino)anilino-6-methyl-7-chlorofluoran, 2,4-dimethyl-6'-{[4-(N,N-dimethylamino)phenyl]amino}-spiro(isobenzofuran-1(3H),9'-[9H]xanthene]-3-one and 3,6-bis(dimethylamino)fluorene-9-spiro-3'-(6'-dimethylamino) phthalide. The basic dyes are not limited to the above and can be used in at least two of them as required.

It is possible to incorporate a heat-fusible substance, preservability improving agent, ultraviolet absorber or the like into the color acceptor-containing layer, the dye-containing layer or a separate layer to give an improved color density and improve the preservability of recorded images.

Examples of useful heat-fusible substances are stearic acid amide, methoxycarbonyl-N-stearic benzamide, N-benzoyl stearic acid amide, N-eicosanic acid amide, stearic acid ethylenebisamide, behenic acid amide, stearic acid methylenebisamide, stearic acid N-methylolamide, dibenzyl terephthalate, dimethyl terephthalate, dioctyl terephthalate, benzyl p-benzyloxybenzoate, 1-hydroxy-2-naphthoic acid phenyl ester, 2-naphthol benzyl ether, m-terphenyl, dibenzyl oxalate, di-p-methylbenzyl oxalate, di-p-chlorobenzyl oxalate, p-benzylbiphenyl, p-tolyl biphenyl ether, di(p-methoxyphenoxyethyl) ether, 1,2-di(3-methylphenoxy)ethane, 1,2-di(4-methylphenoxy)ethane, 1,2-di(4-methoxyphenoxy)ethane, 1,2-di(4-chlorophenoxy) ethane, 1,2-diphenoxyethane, 1-(4-methoxyphenoxy)-2-(3-methylphenoxy)ethane, p-methylthiophenyl benzyl ether, 1,4-di(phenylthio)butane, p-acetotoluidide, p-acetophenetidide, N-acetoacetyl-p-toluidine, di(β-biphenylethoxy)benzene, p-di(vinyloxyethoxy)benzene, 1-isopropylphenyl-2-phenylethane, phenylbenzamide compounds of the formula (2) and diaryloxyalkane compounds of the formula (3)

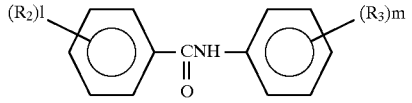

(2)

wherein $R_2$ and $R_3$ are each $C_1$~$C_4$ alkyl, $C_1$~$C_4$ alkoxy or halogen atom, 1 and m are each an integer of 0 to 3,

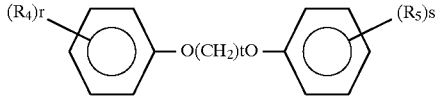

(3)

wherein $R_4$ is tert-butyl, $R_5$ is $C_1$~$C_4$ alkyl, $C_1$~$C_4$ alkoxy or halogen atom, r is an integer of 2 or 3, s is an integer of 0 to 3, t is an integer of 2 to 4.

The heat-fusible substance is not limited to the above and can be used in at least two of them as required.

Examples of useful preservability improving agents are phenol compounds such as 2,2'-methylenebis(4-methyl-6-tert-butylphenol), 2,2'-methylenebis(4-ethyl-6-tert-butylphenol), 2,2'-ethylidenebis-(4,6-di-tert-butylphenol), 4,4'-thiobls(2-methyl-6-tert-butylphenol), 4,4'-butylidenebis (6-tert-butyl-m-cresol), 1-[α-methyl-α-(4'-hydroxyphenyl) ethyl]-4-[α',α'-bis(4"-hydroxyphenyl)ethyl]benzene, 1,1,3-tris(2-methyl-4-hydroxy-5-cyclohexylphenyl)butane, 1,1,3-tris(2-methyl-4-hydroxy-5-tert-butylphenyl)butane, 4,4'-thiobis(3-methylphenol), 4,4'-dihydroxy-3,3',5,5'-tetrabromodiphenylsulfone, 4,4'-dihydroxy-3,3',5,5'-tetramethyldiphenylsulfone, 2,2-bis(4-hydroxy-3,5-dibromophenyl)propane, 2,2-bis(4-hydroxy-3,5-dichlorophenyl)propane, 2,2-bis(4-hydroxy-3,5-dimethylphenyl)propane; epoxy compounds such as 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol novolak type epoxy resin, phenol novolak type epoxy resin and bisphenol A type epoxy resin; N,N'-2-naphthyl-p-phenylenediamine, sodium or polyvalent metal salt of 2,2'-methylenebis(4,6-di-tert-butylphenyl)phosphate and bis(4-ethyleneiminocarbonylaminophenyl)methane. The preservability improving agent is not limited to the above and can be used in at least two of them as required.

Examples of useful ultraviolet absorbers are salicylic acid type ultraviolet absorbers such as phenyl salicylate, p-tert-butylphenyl salicylate and p-octylphenyl salicylate; benzophenone type ultraviolet absorbers such as 2,4-dihydroxybenzophenone, 2-hydroxy-4-methoxybenzophenone, 2-hydroxy-4-octyloxybenzophenone and 2,2'-dihydroxy-4-methoxybenzophenone; benzotriazole type ultraviolet absorbers such as 2-(2'-hydroxy-5'-methylphenyl) benzotriazole, 2-(2'-hydroxy-3',5'-di-tert-butylphenyl)-5-chlorobenzotriazole, 2,2'-methylenebis[4-(1,1,3,3-tetramethylbutyl)-6-(2H-benzotriazole-2-yl)phenol], 2-(2'-hydroxy-5'-tert-butylphenyl)benzotriazole, 2-(2'-hydroxy-3'-tert-butyl-5'-methylphenyl)-5-chlorobenzotriazole, 2-[2'-hydroxy-3'-(3",4",5",6"-tetrahydrophthalimidomethyl)-5'-methylphenyl]-benzotriazole, 2-(2'-hydroxy-5'-tert-octylphenyl)benzotriazole, 2-(2'-hydroxy-3',5'-di-tert-butylphenyl)benzotriazole, 2-4-di-tert-butylphenyl-3,5-di-tert-butyl-4-hydroxybenzoate, 2-[2'-hydroxy-3',5'-bis (α,α-dimethylbenzyl)phenyl]-2H-benzotriazole, 2-(2'-hydroxy-3'-tert-butyl-5'-methylphenyl)-5-chlorobenzotriazole, 2-(2'-hydroxy-3'-dodecyl-5'-methylphenyl)benzotriazole, 2-[2'-hydroxy-4'-2"-ethylhexyloxyphenyl]benzotriazole, octyl 5-tert-butyl-3-(5-chloro-2H-benzotriazole-2-yl)-4-hydroxybenzene-propionate, condensate of methyl-3-[3-tert-butyl-5-(2H-benzotriazole-2-yl)-4-hydroxyphenyl] propionatepolyethylene glycol (molecular weight: about 300) and 2-(2'-hydroxy-3',5'-sec-amylphenyl)-benzotriazole; and cyanoacrylate type ultraviolet absorbers such as 2-ethylhexyl-2-cyano-3,3'-diphenylacrylate and ethyl-2-cyano-3,3'-diphenylacrylate. Preferable among these are benzotriazole ultraviolet absorbers effectively absorbing rays in the ultraviolet region of relatively long wavelengths. The ultraviolet absorber is not limited to the above and can be used in at least two of them as required.

The heat-fusible substance- preservability-improving agent or ultraviolet absorber can be-incorporated into the color acceptor-containing layer and the dye-containing layer. For example, the additive can be dissolved in the solvent, incorporated into the vapor deposition source along with the main agent, or evaporated or sublimed from another deposition source for co-deposition.

A high sensitivity is available especially by forming such layers in the order of color acceptor layer, dye layer and color acceptor layer, or dye layer, color acceptor layer and dye layer; or repeatedly forming the combination of dye layer and color acceptor layer; or forming a layer containing the heat-fusible substance between each pair of adjacent dye layer and color acceptor layer.

Improved stability with time may be afforded by forming the layer of heat-fusible substance, preservability improving agent or ultraviolet absorber between the color acceptor-containing layer and the dye-containing layer. The component of the interposed layer is preferably 70° to 250° C. in melting point.

In the present invention, the above layer containing the color acceptor and the binder as dissolved in an organic solvent is formed directly on a substrate, but an another layer such as an anchor-treated layer and electroconductive layer can be superposed between the substrate and the color acceptor-containing layer.

For example, at least one layer containing a heat-fusible substance, preservability improving agent or ultraviolet absorber can be formed as a separate layer between the basic dye-containing layer and the color acceptor-containing layer being formed by a binder-containing solvent coating method, or formed on the basic dye-containing layer by vapor deposition. In forming these layers, it is possible to place at least one of each of the basic dye, color acceptor, heat-fusible substance, preservability improving agent and ultraviolet absorber in one vapor deposition source and to form a single vapor deposition layer.

Alternately, it is possible to place each of the basic dye, color acceptor, heat-fusible substance, preservability improving agent and ultraviolet absorber in each vapor deposition source and to form a mixed vapor deposition layer or layers. Different materials may be used for each of the components.

The protective layer to be included in the heat sensitive recording material of the invention consists primarily of an aqueous resin and, when desired, further contains a pigment, crosslinking agent, lubricant, etc.

The aqueous resins useful in the protective layer include a water-soluble high polymer, emulsion, etc. Examples of aqueous resins are starches such as oxidized starch, enzyme-modified starch, cation-modified starch, esterized starch and etherized starch; cellulose resins such as methyl cellulose, ethyl cellulose, carboxymethyl cellulose, methoxy cellulose and hydroxyethyl cellulose; polyvinyl alcohols such as completely (or incompletely) saponified polyvinyl alcohol, carboxy-modified polyvinyl alcohol, acetoacetylated polyvinyl alcohol and silicon-modified polyvinyl alcohol; polyvinyl pyrrolidone; acrylic resins, polystyrenes, poly (α-methylstyrene), styrene-butadiene copolymer, polyvinyl acetate, vinyl chloride-vinyl acetate copolymer, ethylene-vinyl acetate copolymer, polyvinyl acetals, polyester resins, polyurethane resins, cumarone resins, nylon resins, casein, styrene-maleic anhydride copolymer and its alkali salt, isobutylene-maleic anhydride copolymer and its alkali salt. The resin is not limited to the above and can be used singly or in at least two of them.

Examples of acrylic monomers which are used for preparing the above acrylic resin are (meth)acrylic acid, (meth) acrylic esters such as methyl (meth)acrylate, ethyl (meth) acrylate and butyl (meth)acrylate, (meth)acrylamide and (meth)acrylonitrile. These acrylic monomers are polymerized singly or in at least two of them. Further, other ethylenically unsaturated monomer such as itaconic acid, vinyl chloride, vinylidene chloride, vinyl acetate, styrene, ethylene, propylene and butadiene can be copolymerized with the acrylic monomer. As required, the acrylic resin can be modified such as hydrolysis and acetalization.

It is desired that the amount of the aqueous resin to be present in the protective layer be adjusted to the range of 30 to 98 wt. % based on the total amount of solids in the protective layer.

Examples of useful pigments are an inorganic pigment such as kaolin, clay, calcium carbonate, aluminum hydroxide, aluminum oxide, calcined clay, calcined kaolin, titanium oxide, talc, zinc oxide, silicone dioxide and colloidal silica; and organic pigment such as styrene microballs, nylon powder, polyethylene powder, urea formalin resin filler, raw starch particles, silicone powder aind acrylic resin fine particles. The pigment is not limited to the above and can be used singly or in at least two of them.

Examples of crosslinking agents for improving the water resistance of the protective layer are dialdehyde compounds such as glyoxal and dialdehyde starch, polyamine compounds such as polyethyleneimine, epoxy compounds, polyamide resins, melamine resins, diglycidyl compounds such as glycerin diglycidyl ether, dimethylolurea compounds, aziridine compounds, block isocyanate compounds, and inorganic compounds such as ammonium persulfate, ferric chloride and magnesium chloride. The crosslinking agent can be used in an amount of 1 to 30 wt. % based on the total amount of solids in the protective layer. The crosslinking agent is not limited to the above and can be used singly or in at least two of them.

Examples of useful lublicants are zinc stearate, calcium stearate; waxes such as polyethylene wax, polypropylene wax, carnauba wax, paraffin wax and ester wax; alkyl phosphates such as lauryl phosphate, oleyl phosphate, stearyl phosphate and alkali metal salt of the phosphate; alkyl sulfonates such as lauryl sulfonate, oleyl sulfonate, stearyl sulfonate and alkali metal salt of the sulfonate; glycerin fatty acid esters such as glyceryl monomiristate, glyceryl monostearate, glyceryl monooleate, glyceryl distearate and glyceryl dioleate; polyglycerin fatty acid esters such ag diglyceryl monolaurate, diglyceryl dilaurate, tetraglyceryl monolaurate, hexaglyceryl monolaurate and decaglyceryl monolaurate:, and silicone oil, among which one having no desensitizing, achromatic or fogging effect needs to be selected. The lubricant is not limited to the above and can be used singly or in at least two of them.

The coating composition for the protective layer is prepared by admixing the aqueous resin, pigment, lubricant, etc. with water serving as a dispersing medium and stirring the mixture. When required, a dispersant, defoaming agent, coloring dye, fluorescent dye, crossling agent, ultraviolet absorber and other assistants can be added to the coating composition.

From the viewpoint of giving improved recordability and transparency, acrylic resin and acetoacetylated polyvinyl alcohol resin are desirable to use, and metal soaps such as zinc stearate, calcium stearate, aluminum stearate or like aliphatic fatty acid metal salt and polyolefin waxes such as polyethylene wax and polypropylene wax are preferred as lubricants. Low-molecular-weight polyolefin waxs, 0.1 to 3 $\mu$m in mean particle size and 1,000 to 10,000 in viscosity average molecular weight, have properties to afford improved lubricity while retaining transparency. It is desired that the amount of the lublicant to be present in the protective layer be adjusted to the range of 1 to 15 wt. % based on the total amount of solids in the protective layer.

When the inorganic pigment is used in the protective layer, colloidal silica is especially effective for giving sustained transparency.

When to be incorporated into the protective layer, colloidal silica up to 7 in pH is desirable for affording sustained transparency.

The invention is not limited particularly as to the solvent coating method to be used in forming the heat sensitive recording layer and/or the method of forming the protective layer. Examples of suitable coating methods include air knife coating, VARI-BAR coating, pure blade coating, rod blade coating, short dwell coating, curtain coating, die coating, gravure coating and microgravure coating.

The amount of the coating composition for forming the protective layer is adjusted in the range of about 0.5 to about 10 g/m$^2$ calculated as dry weight.

An inorganic material can be made into a thin layer by vapor deposition to provide the protective layer on the layer of color acceptor or basic dye. Examples of useful inorganic materials are $Al_2O_3$, $SiO_2$, SiO, MgO, ZnO, $MgF_2$, $CuF_2$, ZnS, $ZrO_2$, $CeO_2$, $In_2O_3$, $SnO_2$, $TiO_2$ and $CaF_2$ . The protective layer has a thickness usually in the range of 5 to 200 nm, preferably 10 to 100 nm.

The substrate to be used is suitably selected from among transparent plastic films or transparent papers having a thickness of 5 to 250 $\mu$m, preferably 10 to 200 $\mu$m, more preferably 20 to 150 $\mu$m. The plastic film to be used is not limited particularly. Useful are synthetic resin transparent films including polyethylene terephthlate, polybutylene terephthalate, polyethylene naphthalate and other polyester films, polyIethylene, polypropylene and other polyolefin films, polyvinyl chloride film, polycarbonate films, polyamide films, polysulfone film, polyether.sulfone film, polyether ether ketone film, polyether imide film, polyphenylene sulfide film, polyester ether film, polyamideimide film, fluorocarbon resin films, polyurethane film, acrylic films, polyvinyl butyral film, polystyrene film, polyvinyl alcohol film and others. These films can be used singly, or as affixed to one another.

When required, a resin layer can be formed on the protective layer and/or the rear surface of the heat sensitive recording material to make the recorded images on the heat sensitive material more preservable, also rendering the material more smoothly head matching through thermal printers and mechanically more adapted therefor. Furthermore, various techniques known in the art of manufacturing heat sensitive recording materials are applicable for treating the rear surface to provide a pressure sensitive adhesive and make the material into a pressure sensitive adhesive label, or for forming a magnetic layer. The material can, of course, be treated by a supercalender after forming the heat sensitive recording layer and the protective layer so as to ensure an improved image quality and higher image density.

When a coating composition containing a resin which is curable by exposure to an electron beam is applied onto the protective layer or the heat sensitive layer and then cured, the resulting material can be given a higher gloss and improved in color density and in plasticizer resistance and water resistance to ensure improved print preservability. Examples of resins curable with electron beams are (A) radical-polymerizable monofunctional monomers such. as acrylic acid, ethyl acrylate, hexyl acrylate, 2-ethylhexy, acrylate, 2-hydroxyethyl acrylate, 2-hydroxypropyl acrylate, tetrahydrofurfuryl acrylate, pheoxyethyl acrylate, tolyloxyethyl acrylate, nonylpheoxyethyl acrylate, tetrahydrofurfuryloxyethyl acrylate, 1,3-dioxolan acrylate, pheoxydiethylene glycol acrylate, benzyl acrylate, butoxyethyl acrylate, cyclohexyl acrylate, dicyclopentanyl acrylate, dicyclopentenyl acrylate, glycidyl acrylate, carbitol acrylate and isobornyl acrylate; (B) radical-polymerizable multifunctional monomers such as 1,6-hexanediol diacrylate, neopentyl glycol diacrylate, diethylene glycol diacrylate, tripropylene glycol diacrylate, dicyclopentanyl diacrylate, butylene glycol diacrylate, pentaerythritol diacrylate, trimethylolpropane triacrylate, propylene oxide-modified trimethylolpropane triacrylate, pentaerythritol triacrylate, ditrimethyloipropane tetracrylate, dipentaerythritol hexacrylate, caprolactone-modified dipentaerythritol hexaacrylate and tetramethylolmethane tetraacrylate; and (C) radical-polymerizable oligomers (prepolymers) such as polyester (poly)acrylate, urethane (poly)acrylate, epoxy (poly) acrylate and polyol (poly)acrylate oligomers.

When desired, suitable additives such as pigment, defoaming agent, leveling agent, lubricant, surfactant and plasticizer can be added to the resin which is curable with an electron beam, i.e., to the prepolymer or monomer exemplified above.

Examples of ionizing radiations are electron beam, ultraviolet rays, alpha rays, beta rays, gamma rays, X rays and neutron beam. Alpha rats, beta rays, gamma rays, X rays and neutro-beam are difficult to handle, so that the electron beam or ultraviolet rays, which are easy to handle, are preferable to use.

For example, the electron beam, when to be used, is applied at a dose in the range of 0.1 to 15 Mrad, preferably about 0.5 to about 10 Mrad. The dose, if less than 0.1 Mrad, fails to fully cure the resin which is curable with ionizing radiation, whereas excessive doses over 15 Mrad are likely to cause color formation or discoloration of the heat sensitive recording material. The resin is irradiated with the electron beam, for example, by the scanning method, curtain beam method or broad beam method. To be suitable, the acceleration voltage is about 100 to about 300 KV.

When ultraviolet rays are to be used, there is a need to incorporate a photoinitiator into the coating composition in an amount of 0.2 to 10 wt. % , preferably about 0.5 to about 5 wt. % , based on the resin curable with ultraviolet rays. The light source for ultraviolet irradiation comprises 1 to 50 ultraviolet lamps, xenon lamps or tungsten lamps. The ultraviolet output is preferably about 40 to about 200 W/cm.

Examples of photoinitiators are thioxanthone, benzoin, benzoin alkyl ether xanthones, dimethylxanthone, benzophenone, anthracene, 2,2-diethoxyacetophenone, benzyldimethylketal, benzyldiphenyl disulfide, anthraquinone, 1-chloroanthraquinone, 2-ethylanthraquinone; 2-tert-butylanthraquinone, N,N-tetraethyl-4,4'-diaminobenzophenone, 1,1'-dichloroacetophenone, etc.

The foregoing electron beam irradiation method is more productive than the ultraviolet irradiation method and free of the problem of odor and coloration due to the addition of photoinitiator, readily forms a uniform crosslinked structure, and is therefore most preferable to use.

The resin curable with the electron beam is applied in an amount which is not always limited but which is preferably adjusted in the range of 0.1 to 20 g/m$^2$, more preferably 0.5 to 10 g/m$^2$, because amounts less than 0.1 g/m$^2$ fail to give the expected effect of the invention and further because amounts exceeding 20 g/m$^2$ are likely to entail a very low record density.

The heat sensitive recording material having an overcoated layer and thus prepared is further subjected to a smoothing treatment as by a supercalender to ensure an improved record density and greatly diminished irregularities in the record density.

The present invention will be described in greater detail with reference to the following examples, whereas the invention is not limited to the examples. The parts and percentages are by weight unless otherwise indicated.

EXAMPLE 1

(1) Preparation of Protective Layer Coating Composition

A mixture was prepared from 100 parts of 10% aqueous solution of acetoacetylated polyvinyl alcohol(Gohsenol Z-210, The Nippon Synthetic Chemical Ind., Co., Ltd.), 25 parts of a polyurethane emulsion of the polyester type having a solids concentration of 20% (Hydran AP-30F, Dainippon Ink and Chemicals Inc.), 3 parts of aluminum hydroxide having a mean particle size of 1.3 $\mu$m, 1 part of 10% aqueous solution of sodium dioctylsulfosuccinate and 10 parts of a dispersion of zinc stearate having a solids content of 20% by stirring these components to obtain a protective layer coating composition.

(2) Preparation of Color Acceptor Coating Composition

A mixture of 9 parts of 4,4'-isopropylidene diphenol and 6 parts of a polyvinylbutyral resin (Denka Butyral # 3000-K, product of Denki Kagaku Kogyo K.K.) was dissolved in 40 parts of ethanol and 45 parts of toluene to prepare a coating composition.

(3) Formation of Heat Sensitive Recording Layer

Onto a polyester film (Lumirror T60, product of Toray Industries, Inc., 100 $\mu$m in thickness) was applied the color acceptor coating composition in an amount of 5 g/m$^2$ when dried, followed by drying. 3-Di(n-butyl)amino-6-methyl-7-anilinofluoran was deposited by vacuum evaporation on the resulting coating to form a layer of the basic dye having a thickness of 1000 nm.

(4) Formation of Protective Layer

The heat sensitive recording layer was coated with the protective layer coating composition in an amount of 2 g/m$^2$ when dried, followed by drying to obtain a heat sensitive recording material.

EXAMPLE 2

A heat sensitive recording material was prepared by the same procedure as in Example 1 with the exception of using the color acceptor coating composition described below.

(1) Preparation of Color Acceptor Coating Composition

A mixture of 20 parts of N-(p-toluenesulfonyl)-N'-phenyl urea and 6 parts of a polyvinylbutyral resin (Denka Butyral # 3000-K, product of Denki Kagaku Kogyo K.K.) was dissolved in 40 parts of ethanol and 45 parts of toluene to prepare a coating composition.

EXAMPLE 3

A heat sensitive recording material was prepared by the same procedure as in Example 2 with the exception of using the protective layer coating composition described below.

(1) Preparation of Protective Layer Coating Composition

A mixture was prepared from 50 parts of an acrylic resin emulsion (Acryset SA558, product of Nippon Shokubai Co., Ltd., 20% in resin solids content), 3 parts of a zinc stearate dispersion having a solids content of 20%, 3 parts of 10% aqueous solution of sodium dioctylsulfosuccinate and 20 parts of 5% aqueous solution of glyoxal by stirring these components to obtain a protective layer coating composition.

EXAMPLE 4

A heat sensitive recording material was prepared by the same procedure as in Example 2 except that 19.2 parts of an acrylic resin emulsion (Polysol AM2250, product of Showa Kobunshi Kogyo Co., Ltd., 52% in resin solids content) and 30.8 parts of water were used in place of 50 parts of the acrylic resin emulsion (Acryset SA558, product of Nippon Shokubai Co., Ltd., 20% in resin solids content).

EXAMPLE 5

A heat sensitive recording material was obtained by the same procedure as in Example 3 except that the color acceptor coating composition was prepared in the following manner.

A mixture of 15 parts of N-(p-toluenesulfonyl)-N'-phenyl urea, 5 parts of di-p-chlorobenzyl oxalate and 6 parts of a polyvinylbutyral resin (Denka Butyral # 3000-K, product of Denki Kagaku Kogyo K.K.) was dissolved in 40 parts of ethanol and 45 parts of toluene to obtain a coating composition.

EXAMPLE 6

A heat sensitive recording material was prepared in the same manner as in Example 3 with the exception of using 3-(N-ethyl-N-n-hexylamino)-6-methyl-7-anilinofluoran in place of 3-di(n-butyl)amino-6-methyl-7-anilinofluoran.

EXAMPLE 7

A heat sensitive recording material was prepared in the same manner as in Example 3 except that a 500-nm-thick layer of heat-fusible substance was formed between the color acceptor layer and the basic dye layer by vacuum evaporation of 1,2-di(3-methylphenoxy)ethane.

EXAMPLE 8

A heat sensitive recording material was obtained by the same procedure as in Example 7 except that 2,4-dihydroxy-2'-methoxybenzanilide was used in place of N-(p-toluenesulfonyl)-N'-phenyl urea.

EXAMPLE 9

Oxygen gas was introduced to a vacuum of $5\times10^{-4}$ Torr into a vacuum chamber in which a polyester film (Lumirror T60, product of Toray Industries, Inc., 100 μm in thickness) was placed, and the color acceptor N-(p-toluenesulfonyl)-N'-phenylurea was deposited on the film by vacuum evaporation with an oxygen plasma generated by application of a high-frequency electric power, 13.56 MHz and 10 W, to form a 2000 nm-thick color acceptor layer on the polyester film. Subsequently 3-di(n-butyl)amino-6-methyl-7-anilinofluoran, a basic dye, was deposited by vacuum evaporation with no plasma generated, whereby a 1200 nm-thick basic dye layer was formed over the color acceptor layer. A protective layer was formed over the resulting heat sensitive recording layer in the same manner as in Example 3.

EXAMPLE 10

A heat sensitive recording material was prepared in the same manner as in Example 9 except that the basic dye layer was formed by vacuum evaporation with a plasma generated under the same conditions as in the vacuum evaporation of the color acceptor layer.

EXAMPLE 11

A heat sensitive recording material was prepared in the same manner as in Example 9 except that a 800-nm-thick layer of heat-fusible substance, i.e., 1,2-di(3-methylphenoxy)ethane, was formed between the color acceptor layer and the basic dye layer by the vacuum evaporation.

EXAMPLE 12

A heat-sensitive recording material was prepared in the same manner as in Example 9 except that N-(p-toluenesulfonyl)-N'-phenylurea serving as a color acceptor and 1,2-di(3-methylphenoxy)ethane serving as a heat-fusible substance are deposited in a vacuum in a weight ratio of 5:1 from separate sources conjointly with an oxygen plasma generated under the same conditions as in Example 9 to form a 2500 nm-thick color acceptor layer in place of the color acceptor layer formed in Example 9.

EXAMPLE 13

A heat sensitive recording material was prepared in the same manner as in Example 1 with the exception of using the protective layer coating composition described below.

(1) Protective Layer Coating Composition

A mixture was prepared from 30 parts of 10% aqueous solution of acetoacetylated polyvinyl alcohol (Gohsenol Z-210, product of The Nippon Synthetic Chemical Ind., Co., Ltd.), 30 parts of colloidal silica having a solids concentration of 20% (Snowtex 0, 2~4 in pH, product of Nissan Chemical Industries, Ltd.), 1 part of 10% aqueous solution of sodium dioctylsulfosuccinate, 1 part of a zinc stearate dispersion having a solids content of 36% and 1 part of 5% glyoxal aqueous solution by stirring these components for use as a protective layer coating composition.

EXAMPLE 14

A heat sensitive recording material was prepared in the same manner as in Example 1 with the exception of using the protective layer coating composition stated below.

(1) Protective Layer Coating Composition

A mixture was prepared from 30 parts of 10% aqueous solution of acetoacetylated polyvinyl alcohol (Gohsenol Z-210, product of The Nippon Synthetic Chemical Ind., Co., Ltd.), 30 parts of colloidal silica having a solids concentration of 20% (Snowtex 0, 2~4 in pH, product of Nissan Chemical Industries, Ltd.), 1 part of 10% aqueous solution of sodium dioctylsulfosuccinate, 2 parts of a polyethylene wax dispersion having a solids content of 40% (Chemipearl W-900, 0.6 μm in mean particle size, 4000 in viscosity average molecular weight, product of Mitsui Petrochemical Industries, Ltd.) and 1 part of 5% glyoxal aqueous solution by stirring these components for use as a protective layer coating composition.

EXAMPLE 15

A heat sensitive recording material was prepared in the same manner as in Example 14 except that polyethylene wax dispersion (Chemipearl W-950, 0.6 μm in mean particle size, 2000 in viscosity average molecular weight, product of Mitsui Petrochemical Industries, Ltd.) was used in place of polyethylene wax dispersion (Chemipearl W-900).

EXAMPLE 16

A heat sensitive recording material was prepared in the same manner as in Example 14 except that polypropylene wax dispersion (Chemipearl W-100, 1 μm in mean particle size, 7000 in viscosity average molecular weight, product of Mitsui Petrochemical Industries, Ltd.) was used in place of polyethylene wax dispersion (Chemipearl W-900).

EXAMPLE 17

A heat sensitive recording material was prepared by coating a polyester film with the same color acceptor as used in Example 3 in an amount of 5 g/m$^2$, drying the coating, depositing 1,2-di(3-methylphenoxy)ethane, a heat-fusible substance, on the coating by vacuum evaporation to form a 800 nm-thick layer of heat-fusible substance, depositing 3-diethylamino-6-methyl-7-anilinofluoran on the resulting layer by vacuum evaporation to a thickness of 2000 μm, depositing the heat-fusible substance 1,2-di(3-methylphenoxy)ethane on the fluoran dye layer by vacuum evaporation to a thickness of 800 nm, and depositing N-(p-toluenesulfonyl)-N'-phenylurea, a color acceptor, on the resulting layer to a thickness of 1000 nm by vacuum evaporation with an oxygen plasma produced under the same conditions as the oxygen plasma used in Example 9, followed by the formation of a protective layer in the same manner as in Example 3.

EXAMPLE 18

A heat sensitive recording material was prepared in the same manner as in Example 17 except that instead of forming the color acceptor-containing layer on the polyester film with the solvent coating composition, a layer of color acceptor was deposited on a polyester film with a plasma generated by the same color acceptor layer forming procedure as in Example 9.

EXAMPLE 19

A heat sensitive recording material was prepared in the same manner as in Example 7 with the exception of using 4-methoxyphenylbenzanilide in place of the 1,2-di(3-methylphenoxy)ethane of Example 7.

EXAMPLE 20

A heat sensitive recording material was prepared in the same manner as in Example 7 with the exception of using 1-(3,5-di-tert-butylphenoxy)-2-(2,4-dimethylphenoxy) ethane in place of the 1,2-di(3-methylphenoxy)ethane of Example 7.

COMPARATIVE EXAMPLE 1

A heat sensitive recording material was prepared in the same manner as in Example 1 except that the heat sensitive recording layer was formed by the following different procedure.

(1) Preparation of Composition A

A mixture of 20 parts of 3-di(n-butyl)amino-6-methyl-7-anilinofluoran, 10 parts of 1,2-di(3-methylphenoxy)ethane, 20 parts of 5% aqueous solution of methyl cellulose and 60 parts of water was pulverized in a sand mill to a mean particle size of 0.8 $\mu$m.

(2) Preparation of Composition B

A mixture of 20 parts of 4,4'-isopropylidenediphenol, 20 parts of 5% aqueous solution of methyl cellulose and 40 parts of water was pulverized in a sand mill to a mean particle size of 0.8 $\mu$m.

(3) Preparation of Heat Sensitive Recording Layer Coating Composition

A mixture was prepared from 120 parts of Composition A, 80 parts of Composition B, 58 parts of a styrene-butadiene latex (Latex L-1571, Asahi Chemical Industry Co., Ltd. 48% in solids content), 1 part of 10% aqueous solution of sodium dioctylsulfosuccinate and 75 parts of water by stirring the components to obtain a recording layer coating composition.

(4) Formation of Heat Sensitive Recording Layer

The same polyester film as used in Example 1 was coated with the coating composition in an amount of 7 g/m$^2$ when dried, followed by drying to form a heat sensitive recording layer.

COMPARATIVE EXAMPLE 2

A heat sensitive recording material was prepared in the same manner as in Example 1 except that instead of forming the color acceptor layer with use of a solvent composition for forming the recording layer, 4,4'-isopropylidenediphenol was deposited by vacuum evaporation to form a 2000 nm-thick layer of color acceptor.

COMPARATIVE EXAMPLE 3

A heat sensitive recording material was prepared in the same manner as in Example 1 except that the heat sensitive recording layer was formed by the following different procedure.

(1) Preparation of Composition A

A mixture of 9 parts of 4,4'-isopropylidenediphenol and 6 parts of a polyvinylbutyral resin (Denka Butyral # 3000-K, product of Denki Kagaku Kogyo K.K.) was dissolved in 40 parts of ethanol and 45 parts of toluene to prepare a coating composition.

(2) Preparation of Composition B

A mixture of 15 parts of 3-di(n-butyl)amino-6-methyl-7-anilinofluoran, 10 parts of the styrene-butadiene latex (Latex L-1571, Asahi Chemical Industry Co., Ltd. 48% in solids content) and 75 parts of water was pulverized in a sand mill to a mean particle size of 0.5 $\mu$m.

(3) Formation of Heat Sensitive Recording Layer

A heat sensitive recording layer was formed by coating the same polyester film as used in Example 1 with Composition A in an amount of 3 g/m$^2$ when dried, drying the coating, coating the resulting coating with Composition B in an amount of 3 g/m$^2$ when dried, and drying the coating.

COMPARATIVE EXAMPLE 4

A heat sensitive recording material was prepared in the same manner as in Example 9 except that the layer of color acceptor was formed by vacuum evaporation with no plasma generated.

The heat sensitive recording materials thus prepared were evaluated.

[Methods of Evaluation]

1. Record density

The material was used on a thermal printer (UP-860, product of SONY Corporation) for recording, and the recorded images were checked for density by a Macbeth densitometer (TD-904, product of Macbeth Corp.).

2. Transparency of Recording Material: haze value

The material was treated at a temperature of 40° C. and humidity of 50% RH for 24 hours. The haze value of the material was measured before and after the treatment by a haze meter (TC-H1V, product of Tokyo Denshoku Co., Ltd.).

3. Coloring ability

The material was checked for coloring ability by measuring transmission density in the ultraviolet region with use of a Macbeth densitometer (TD-904, product of Macbeth Corp.). Table 1 shows the results.

TABLE 1

| | Transparency (haze value) | | Recording density | Coloring ability ※ |
|---|---|---|---|---|
| | before treatment | 40° C. 50% RH | (recorded image) | (before treatment) |
| Ex. 1 | 18 | 19 | 0.8 | 0.19 |
| Ex. 2 | 18 | 18 | 1.0 | 0.19 |
| Ex. 3 | 11 | 11 | 1.0 | 0.17 |
| Ex. 4 | 11 | 11 | 1.0 | 0.17 |
| Ex. 5 | 12 | 12 | 1.1 | 0.17 |
| Ex. 6 | 11 | 11 | 1.0 | 0.17 |
| Ex. 7 | 12 | 12 | 1.2 | 0.17 |
| Ex. 8 | 12 | 12 | 1.2 | 0.17 |
| Ex. 9 | 11 | 11 | 1.2 | 0.41 |
| Ex. 10 | 11 | 11 | 1.2 | 0.42 |
| Ex. 11 | 13 | 13 | 1.6 | 0.41 |
| Ex. 12 | 13 | 13 | 1.3 | 0.41 |
| Ex. 13 | 8 | 8 | 0.8 | 0.17 |
| Ex. 14 | 7 | 7 | 0.8 | 0.17 |
| Ex. 15 | 7 | 7 | 0.8 | 0.17 |
| Ex. 16 | 7 | 7 | 0.8 | 0.17 |
| Ex. 17 | 14 | 15 | 2.0 | 0.30 |
| Ex. 18 | 14 | 15 | 2.3 | 0.48 |
| Ex. 19 | 11 | 11 | 1.2 | 0.17 |
| Ex. 20 | 11 | 11 | 1.2 | 0.17 |
| Com. Ex. 1 | 40 | 40 | 0.8 | 0.40 |
| Com. Ex. 2 | 45 | 45 | 0.8 | 0.22 |
| Com. Ex. 3 | 30 | 30 | 0.5 | 0.35 |
| Com. Ex. 4 | 11 | 35 | 1.2 | 0.17 |

※ The value of Examples 9 to 12, 17 and 18 shows the absorption occurs in the ultraviolet region. The value of Comparative Examples 1 to 3 is considered by diffused reflection of light caused by low transparency.

Effect of the Invention

The layer containing a color acceptor is formed by an binder-containing solvent coating method and/or vapor deposition effected with a plasma created, and the layer containing a dye is formed by vapor deposition or vapor deposition effected with a plasma generated. This gives high transparency and a satisfactory chromogenic density to the heat sensitive recording material obtained as will be apparent from the table.

We claim:

1. A heat sensitive recording material wherein a transparent substrate is formed with a heat sensitive recording layer thereon, the heat sensitive recording material being characterized in that the heat sensitive recording layer comprises at least a layer containing a color acceptor and a layer containing a basic dye, the color acceptor-containing layer being formed by a binder-containing solvent coating method and/or vapor deposition effected with a plasma generated, the dye-containing layer being formed by vapor deposition or vapor deposition effected with a plasma generated.

2. A heat sensitive recording material as defined in claim 1 wherein the color acceptor is an organic compound which is capable of forming a color on contact with a basic dye and which remains free of the crystallization set forth in JIS K 0211 when checked for melting point and melting point range according to JIS K 0064 by melting the compound in a capillary tube until any solid no longer remains, further maintaining the melting end-point temperature for 5 minutes to hold the compound in its final molten state, and allowing the compound-containing tube to stand in an atmosphere of 0° C. for 5 hours, as placed into this atmosphere within 10 seconds thereafter.

3. A heat sensitive recording material as defined in claim 1 wherein the color acceptor is an organic phosphoric acid compound, phenolic compound, aromatic carboxylic acid compound or a compound having an arylsulfonylaminocarbonylamino group.

4. A heat sensitive recording material as defined in claim 3 wherein the compound having an arylsulfonylaminocarbonylamino group is represented by the formula (1) below $$R_1-SO_2NH\underset{\underset{O}{\|}}{C}NH- \qquad (1)$$

wherein $R_1$ is unsubstituted aromatic group or aromatic group substituted with at least one selected among lower alkyl, lower alkoxy and halogen atom.

5. A heat sensitive recording material as defined in claim 1 wherein the color acceptor-containing layer is formed by an binder-containing solvent coating method, and the basic dye-containing layer is formed by vapor deposition.

6. A heat sensitive recording material as defined in claim 1 wherein at least one of a heat-fusible substance, preservability improving agent and ultraviolet absorber, each having a melting point of 70° to 250° C. is incorporated in at least one of the color acceptor-containing layer, the basic dye-containing layer and other separate layer in the heat sensitive recording layer.

7. A heat sensitive recording material as defined in claim 1 wherein a benzanilide compound of the formula 2 and/or a diaryloxyalkane compound of the formula 3 is incorporated in at least one of the color acceptor-containing layer, the basic dye-containing layer and other separate layer in the heat sensitive recording layer

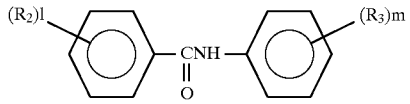

(2)

wherein $R_2$ and $R_3$ are each $C_1$~$C_4$ alkyl, $C_1$~$C_4$ alkoxy or halogen atom, 1 and m are each an integer of 0 to 3,

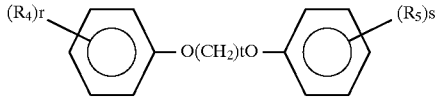

(3)

wherein $R_4$ is tert-butyl, $R_5$ is $C_1$~$C_4$ alkyl, $C_1$~$C_4$ alkoxy or halogen atom, r is an integer of 2 or 3, s is an integer of 0 to 3, t is an integer of 2 to 4.

8. A heat sensitive recording material as defined in claim 1 wherein a protective layer consisting primarily of an acrylic resin and a metal soap is, formed on the heat sersitiive recording layer.

9. A heat sensitive recording material as defined in claim 1 wherein the heat sensitive recording layer comprises at least three layers, each layer comprising, as a main component, the color acceptor, the basic dye and the color acceptor, or the basic dye, the color acceptor and the basic dye, respectively.

* * * * *